US007458197B2

(12) United States Patent
Hanson et al.

(10) Patent No.: US 7,458,197 B2
(45) Date of Patent: Dec. 2, 2008

(54) WEB PACKAGING PASTEURIZATION SYSTEM

(75) Inventors: Robert E. Hanson, Middleton, WI (US); Craig R. Bonneville, Appleton, WI (US); Tou T. Vang, Lodi, WI (US); Vernon D. Karman, Poynette, WI (US); Gary Lee Hahn, Sun Prairie, WI (US); Nelly Feze, Madison, WI (US); John J. Jurkowski, Middleton, WI (US)

(73) Assignee: Alkar-RapidPak, Inc., Lodi, WI (US)

( * ) Notice: Subject to any disclaimer, the term of this patent is extended or adjusted under 35 U.S.C. 154(b) by 0 days.

(21) Appl. No.: 10/930,631

(22) Filed: Aug. 31, 2004

(65) Prior Publication Data

US 2005/0022468 A1 Feb. 3, 2005

Related U.S. Application Data

(63) Continuation of application No. 10/243,093, filed on Sep. 13, 2002, now Pat. No. 6,843,043.

(51) Int. Cl.
*B65B 31/02* (2006.01)

(52) U.S. Cl. ..... 53/511; 53/433; 53/111 R; 426/407; 426/511

(58) Field of Classification Search ..... 53/428, 53/431, 432, 433, 434, 510, 511, 512, 79, 53/111 R; 426/407, 511
See application file for complete search history.

(56) References Cited

U.S. PATENT DOCUMENTS

| | | | |
|---|---|---|---|
| 2,364,049 | A | 12/1944 | Bensel |
| 2,779,681 | A | 1/1957 | Sell et al. |
| 3,597,228 | A | 8/1971 | Jeppson et al. |
| 3,843,806 | A | 10/1974 | Kishpaugh et al. |
| 3,889,009 | A | 6/1975 | Lipoma |
| 3,906,115 | A | 9/1975 | Jeppson |
| 3,961,090 | A | 6/1976 | Weiner et al. |

(Continued)

FOREIGN PATENT DOCUMENTS

| | | |
|---|---|---|
| EP | 0261929 | 3/1988 |

(Continued)

OTHER PUBLICATIONS

*Steam Surface Pasteurization of Beef Frankfurters*; M. Cygnarowicz-Provost, R. C. Whiting and J.C. Craig, Jr.; Journal of Food Science—vol. 59, No. 1, 1994, pp. 1-5.

(Continued)

*Primary Examiner*—Christopher Harmon
(74) *Attorney, Agent, or Firm*—Andrus, Sceales, Starke & Sawall, LLP

(57) ABSTRACT

In a web packaging machine (10) and method packaging a food product (P) between upper and lower webs (14 and 25), wherein the lower web (14) is transported through a series of stations which form the lower web (14) into a component of a package at a forming station (18), and receive the food product (P) at a loading station (20), and close the package with the upper web (25) at a closing station (26), a pasteurization station (300) is provided between the loading station (20) and the closing station (26) and pasteurizing the food product (P).

1 Claim, 5 Drawing Sheets

U.S. PATENT DOCUMENTS

| | | | | | |
|---|---|---|---|---|---|
| 3,966,980 | A | | 6/1976 | McGuckian | |
| 3,992,850 | A | * | 11/1976 | Vetter | 53/510 |
| 4,045,939 | A | * | 9/1977 | Baumstingl | 53/426 |
| 4,391,862 | A | | 7/1983 | Bornstein et al. | |
| 4,448,792 | A | | 5/1984 | Schirmer | |
| 4,533,515 | A | * | 8/1985 | Witter et al. | 422/26 |
| 4,602,262 | A | * | 7/1986 | Milligan et al. | 347/130 |
| 4,606,262 | A | | 8/1986 | Robinson, Jr. et al. | |
| 4,656,042 | A | * | 4/1987 | Risler | 426/396 |
| 4,737,373 | A | | 4/1988 | Forney | |
| 4,782,643 | A | * | 11/1988 | Stark | 53/127 |
| 4,897,985 | A | | 2/1990 | Buchko et al. | |
| 4,905,454 | A | * | 3/1990 | Sanfilippo et al. | 53/432 |
| 4,909,022 | A | | 3/1990 | Kubis et al. | |
| H762 | H | | 4/1990 | DeMasi et al. | |
| 4,948,610 | A | | 8/1990 | Goglio | |
| 4,996,824 | A | * | 3/1991 | Torterotot | 53/426 |
| 5,001,878 | A | | 3/1991 | Sanfilippo et al. | |
| 5,043,175 | A | | 8/1991 | Bayley et al. | |
| 5,152,968 | A | * | 10/1992 | Foti et al. | 422/304 |
| 5,155,974 | A | | 10/1992 | Garwood | |
| 5,170,611 | A | | 12/1992 | Buchko et al. | |
| 5,195,294 | A | * | 3/1993 | Baranowski | 53/167 |
| 5,205,110 | A | | 4/1993 | Buchko et al. | |
| 5,269,216 | A | | 12/1993 | Corominas | |
| 5,271,207 | A | | 12/1993 | Epstein et al. | |
| 5,281,428 | A | | 1/1994 | Morgan | |
| 5,298,270 | A | | 3/1994 | Morgan | |
| 5,344,609 | A | | 9/1994 | Long | |
| 5,356,649 | A | | 10/1994 | LaMotta et al. | |
| 5,366,746 | A | | 11/1994 | Mendenhall | |
| 5,374,437 | A | | 12/1994 | Corominas | |
| 5,422,130 | A | * | 6/1995 | Fox et al. | 426/234 |
| 5,443,150 | A | | 8/1995 | Buchko | |
| 5,466,498 | A | | 11/1995 | Forloni et al. | |
| 5,470,597 | A | | 11/1995 | Mendenhall | |
| 5,512,312 | A | | 4/1996 | Forney et al. | |
| 5,514,403 | A | | 5/1996 | Webb et al. | |
| 5,524,419 | A | | 6/1996 | Shannon | |
| 5,537,916 | A | | 7/1996 | Corominas | |
| 5,577,367 | A | * | 11/1996 | Abrams et al. | 53/425 |
| 5,682,729 | A | | 11/1997 | Buchko | |
| 5,711,981 | A | * | 1/1998 | Wilson et al. | 426/511 |
| 5,718,101 | A | * | 2/1998 | Noel et al. | 53/432 |
| 5,741,536 | A | | 4/1998 | Mauer et al. | |
| 5,749,203 | A | | 5/1998 | McGowan | |
| 5,785,270 | A | | 7/1998 | Buchko | |
| 5,816,024 | A | * | 10/1998 | Sanfilippo et al. | 53/432 |
| 5,822,951 | A | | 10/1998 | Rosik | |
| 5,834,049 | A | | 11/1998 | Kageyama | |
| 5,932,265 | A | | 8/1999 | Morgan | |
| 5,952,027 | A | | 9/1999 | Singh | |
| 6,021,625 | A | * | 2/2000 | Cerwin et al. | 53/425 |
| 6,085,490 | A | | 7/2000 | Buchko | |
| 6,086,936 | A | | 7/2000 | Wilson et al. | |
| 6,202,388 | B1 | | 3/2001 | Sanfilippo et al. | |
| 6,245,294 | B1 | | 6/2001 | Goldberg et al. | |
| 6,269,946 | B1 | | 8/2001 | Colombo | |
| 6,291,003 | B1 | * | 9/2001 | Riemann et al. | 426/511 |
| 6,622,457 | B2 | * | 9/2003 | Kurth | 53/425 |
| 6,718,735 | B2 | * | 4/2004 | Lewis et al. | 53/425 |
| 6,748,726 | B2 | * | 6/2004 | Rossi et al. | 53/510 |
| 6,843,043 | B2 | * | 1/2005 | Hanson et al. | 53/510 |
| 2002/0119073 | A1 | | 8/2002 | McGowan | |
| 2004/0018283 | A1 | | 1/2004 | Hirschey et al. | |
| 2004/0018284 | A1 | | 1/2004 | Kuethe et al. | |

FOREIGN PATENT DOCUMENTS

| | | |
|---|---|---|
| JP | SHO 62-1487439 | 7/1985 |
| JP | SHO 59-065773 | 3/1989 |
| JP | 09-058613 | 3/1997 |

OTHER PUBLICATIONS

Office Action for corresponding Australian Patent Application No. 2003227294 dated May 9, 2008.

Asselbergs, E.A. et al; *Studies on the Application of Infrared in Food Processing*; Plant Research Institute, Canada Department of Agriculture, Ottawa; 1960; pp. 449-453.

Ginzburg, A.S.; *Application of Infra-red Radiation in Food Processing*; Chemical and Process Engineering Series; C.R.C. Press-Cleveland; 1969; pp. 292-297.

Dagerskog, Magnus; *Infra-Red Radiation for Food Processing II. Calculation of Heat Penetration During Infra-Red Frying of Meat Products*; Lebensm.-Wiss. u.—Technol., 12; 1979; pp. 252-256.

Blankenship, L.C. et al; *Cooking Methods for Elimination of Salmonella typhimurium Experimental Surface Containment from Rare Dry-Roasted Beef Roasts*; Journal of Food Science, vol. 45 (1980); pp. 270-272.

Sandu, Constantine; *Infrared Radiative Drying in Food Engineering: A Process Analysis*; Department of Food Science, University of Wisconsin-Madison, Madison, Wisconsin; Biotechnology Progress (vol. 2, No. 3); Sep. 1986; pp. 109-119.

Hallstrom, Bengt et al; *Heat Transfer and Food Products*; Elsevier Science; New York, New York, 1988; pp. 214-231.

*Radiant Wall Oven Applications*; Pyramid Manufacturing, 1996.

Hanson, Robert E.; *Reducing Process Variation in the Cooking and Smoking Process*; Processing Technologies; American Meat Science Association; 50th Annual Reciprocal Meat Conference; 1997; pp. 33-42.

*Browning in Traditional Continuous Ovens Up and Down or Sideways Only?*; Unitherm Food Systems, Inc.; Unitherm Bulletin: Jul. 16, 1997.

Islam, MD. Mahbulbul; *Shelf Life Extension and Pathogen Reduction of Fresh Chicken Through Surface Pasteurization Using Radiant Heat and Anti-Microbial Agents*; UMI Dissertation Services, A Bell & Howell Information Company; 1998; pp. 1-139.

Shackelford, S.D. et al; *Effects of Blade Tenderization, Vacuum Massage Time and Salt Level on Chemical, Textural and Sensory Characteristics of Precooked Chuck Roasts*; Journal of Food Science, vol. 54, No. 4, 1989; pp. 843-905.

Hardin, Margaret D. et al; *Survival of Listeria Monocytogenes in Postpasteurized Precooked Beef Roasts*; Journal of Food Protection, vol. 56, Aug. 1993; pp. 655-659.

Cooksey, D. Kay et al; *Reduction of Listeria Monocytogenes in Precooked Vacuum-Packaged Beef Using Postpackaging Pasteurization*; Journal of Food Protection; vol. 56; Dec. 1993; pp. 1034-1038.

Shaw, Robert; *Extending the Shelf-Life of Chilled Ready Meals*; Meat Quality and Meat Packaging; 1998; pp. 359-367.

Rhodehamel, E. Jeffery et al; *Post Processing Pasteurization of Processed Meats*, American Meat Science Association; Annual Reciprocal Meat Conference; vol. 52; Jun. 23, 1999; pp. 113-114.

*Proceedings of the 1993 Food Preservation 2000 Conference*; Science and Technology Corporation; Oct. 19-21, 1993; Natick, Massachusetts; pp. 512-520.

Leistner, Lothar et al; *Food Preservation by Hurdle Technology*; Elsevier Science Ltd.; Trends in Food Science & Technology; Feb. 1995 (vol. 6); pp. 41-46.

Gould, G.W.; *New Methods of Food Preservation*; Blackie Academic & Professional; 1995.

Marth, Elmer H.; *Extended Shelf Life Refrigerated Foods: Microbiological Quality and Safety*; FoodTechnology; Scientific Status Summary; vol. 52, No. 2; Feb. 1998; pp. 57-62.

Leistner, Lothar; *Combined Methods for Food Preservation*; Handbook of Food Preservation; Marcel Dekker, Inc.; New York, New York, 1999; pp. 457-484.

Leistner, Lothar; *Basic Aspects of Food Preservation by Hurdle Technology*; Elsevier Science.; International Journal of Food Microbiology 55; 2000; pp. 181-186.

AMI Annual Convention; *Update: Post-Process Surface Pasteurization of Ready-to-Eat Meats*; Oct. 24-26, 2002; New Orleans, LA.

Delaquis, P.J. et al; *Microbiological Stability of Pasteurized Ham Subjected to a Secondary Treatment in Retort Pouches*; Journal of Food Protection; vol. 49; Jan. 1986; pp. 42-46.

Mulder, R.W.A.W. et al; *The Microbiological Shelf Life of Vacuum Packed Broiled Chickens*; Archiv for Lebensmittelhygiene; (5); May 31, 1999; pp. 108-111.

McGuckian , Col. Ambrose T.; *The A.G.S. Food System—Chilled Pasteurized Food*; May 1969; pp. 87-99.

Stanek, T.G.; *Precooked Pork Loin For Further Process*; Cryovac memo; Feb. 17, 1986.

Albertsen, Soren; *Alkar Sales Activity Report*; Jun. 16, 1999.

Cargill, *Product Specification for Riverside Smoked Deli*; Jun. 26, 1992.

Unitherm, *Pasteurizing protection*, showing public use in 1997 at Plainville Farms, Plainville, NY.

Hanson, *Brine Chilling of Roasted Pork and Poultry Products for Bil Mar Foods*; Dec. 14, 1995.

Alkar, *Bil Mar Zeeland, MI Serpentine Chiller Plant Layout*, Mar. 4, 1996.

Hanson, *Post packaging pasteurization*; Alkar memo to Bil Mar; Jun. 25, 1998.

Bil Mar, *Food Service Brochure for Sara Lee Turkey products*; Dec. 29, 1998.

Bil Mar, *Food Service Priority List by SKU for Post Pasteurization of Key Products*; Dec. 29, 1998.

Bil Mar, *Surface Thermal Processing Product List*; Jan. 7, 1999.

Wasson, *Alkar Sales Activity Report re Bil Mar Zeeland, MI plant*; Jan. 7, 1999.

Betley, *Alkar Pasteurization Tests for Bil Mar Foods*; Jan. 20, 1999.

Wasson, *Alkar Sales Activity Report re Bil Mar Zeeland, MI plant*; Feb. 19, 1999.

Alkar, "*Revised" Proposal, 1 of 3, One* (1) *Field Erected Continuous Vertical Serpentine Hot Water Pasteurization Zone to be Added to the One* (1) *Field Erected Continuous Vertical Serpentine Brine Chiller* (*Ref. JT 3067*) *that is at Alkar's Plant in Lodi*, Wisconsin; Jun. 3, 1999.

Bil Mar, *Purchase Order for Serpentine Hot Water Pasteurization Zone for Bil Mar Zeeland, MI*; Jun. 4, 1999.

Alkar, *Bil Mar Zeeland Pasteurizer/Chiller Plant Layout*; Jul. 12, 1999.

Specialized Patent Services, U.S. Trademark Application for *Stamp Design*; Serial No. 75/655508; dated Mar. 8, 1999.

Unitherm, *Smoking and Browning under 10 minutes*!; advertisement; Meat & Poultry magazine; Apr. 28, 1998.

Morgan, Arthur I. et al; *Surface Pasteurization of Raw Poultry Meat by Steam*; U.S. Department of Agriculture Research, Agriculture Research Service, Eastern Regional Research Center (Received May 15, 1995; accepted Sep. 21, 1996); 199th Academic Press Limited.

Morgan, Arthur I., et al; *Ultra High Temperature, Ultra Short Time Surface Pasteurization of Meat*; Journal of Food Science—vol. 61, No. 6, 1996 (pp. 1216-1218).

Kozempel, Michael, et al; *Application of the vacuum/steam/vacuum surface intervention process to reduce bacteria on the surface of fruits and vegetables*; Innovative Food Science & Emerging Technologies 3 (2002) 63-72; US Department of Agriculture, Agricultural Research Service, Eastern Regional Research Center, Engineering Science Research Unit; Accepted Jan. 6, 2002; 2002 Elsevier Science Ltd.; pp. 63-72.

Kozempel, Michael, et al; Journal of Food Protection, vol. 63, No. 4, 2000, pp. 457-461; *Rapid Hot Dog Surface Pasteurization Using Cycles of Vacuum and Steam to Kill Listeria innocua*; U.S. Department of Agriculture, Agricultural Research Service, Eastern Regional Research Center; Engineering Science Research Unit; MS 99-252; Received Aug. 27, 1999/Accepted Nov. 5, 1999; pp. 457-461.

Japanese Patent Laid-open No. Sho 53-025189, 1978.

Japanese Patent Laid-open No. Hei 10-099061, 2003.

* cited by examiner

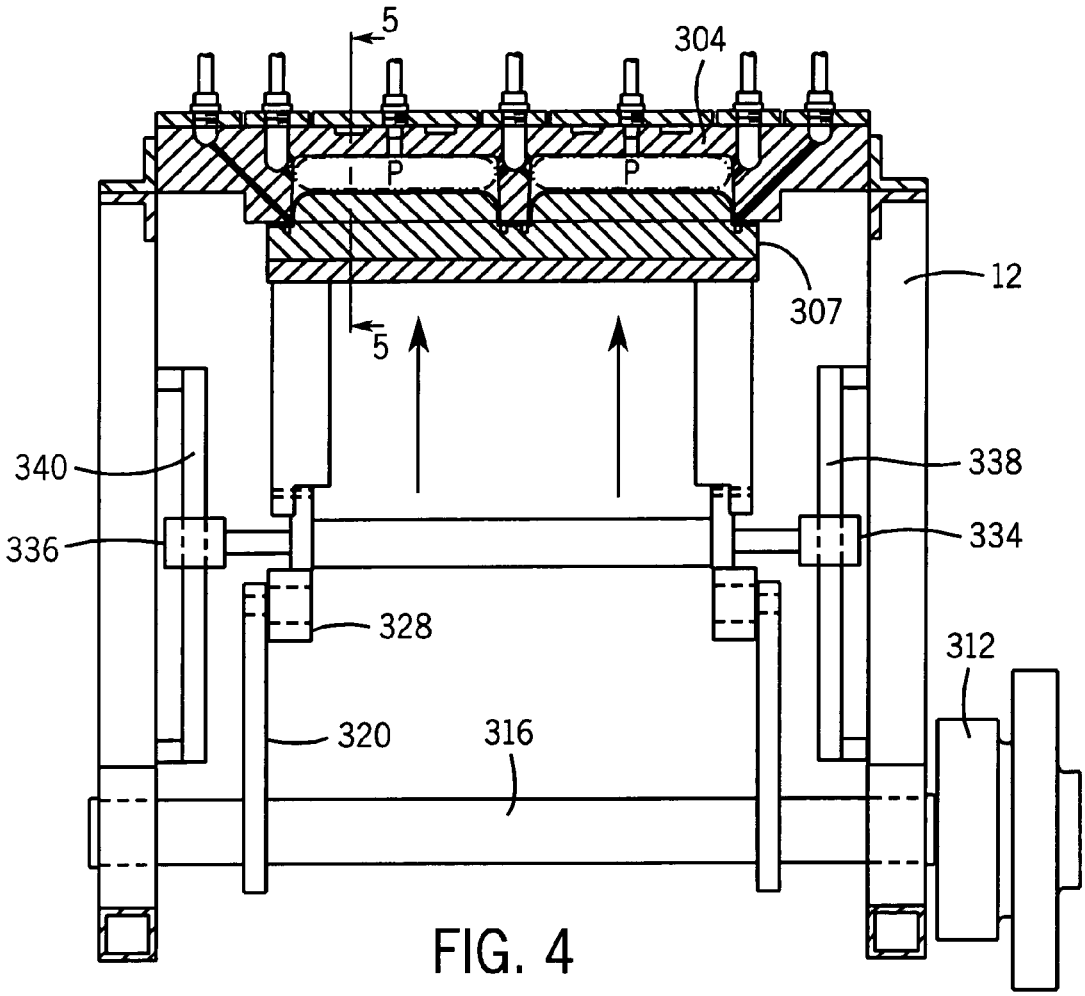
FIG. 4
FIG. 5
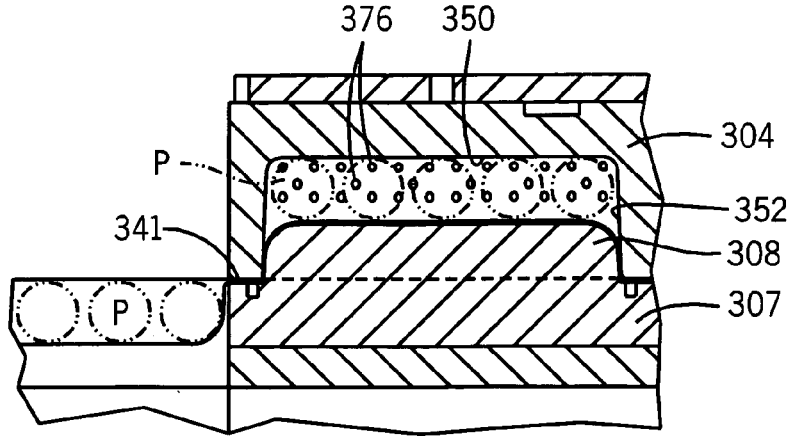

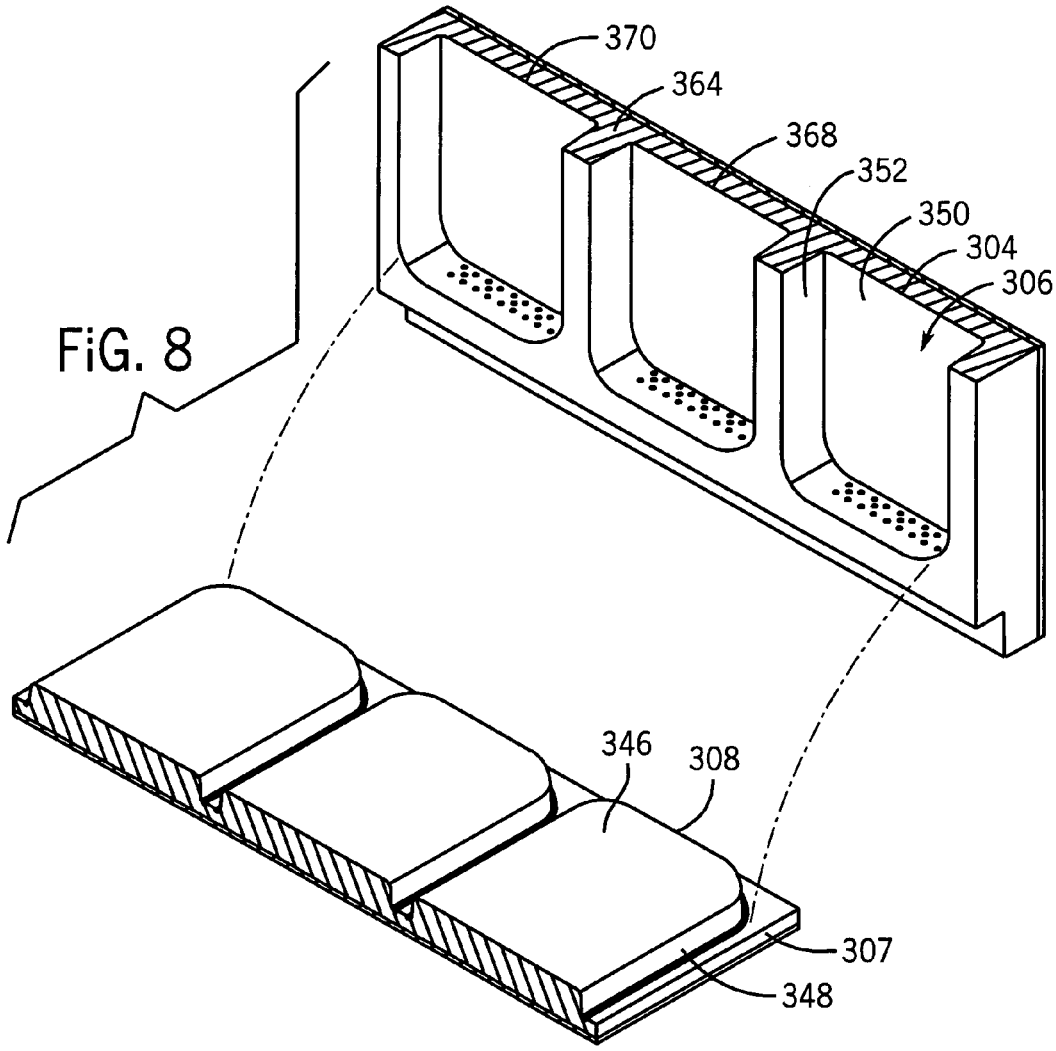
FiG. 8
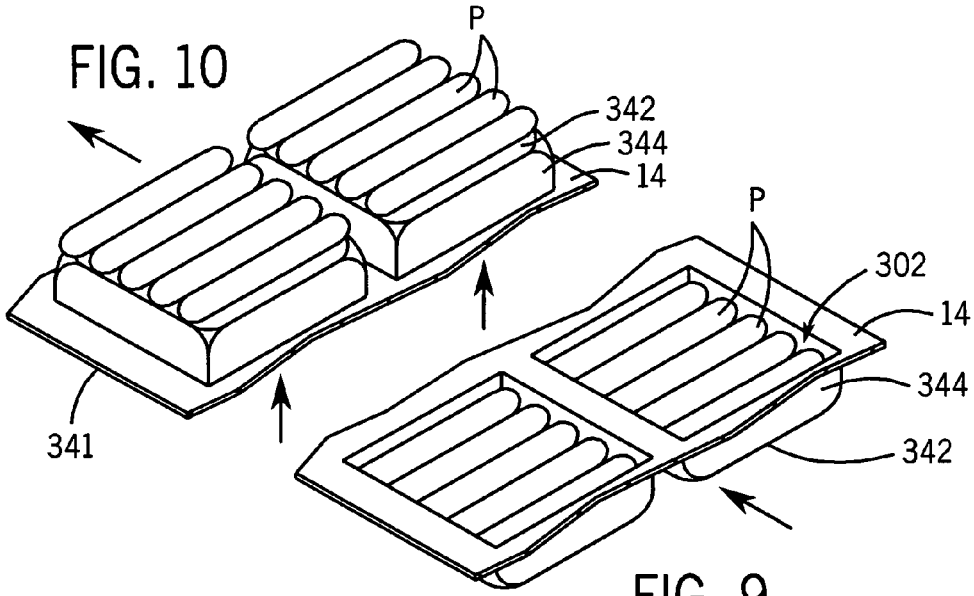
FIG. 10
FIG. 9

WEB PACKAGING PASTEURIZATION SYSTEM

CROSS REFERENCE TO RELATED APPLICATION

This application is a continuation of U.S. patent application Ser. No. 10/243,093, filed Sep. 13, 2002 now U.S. Pat. No. 6,843,043.

BACKGROUND AND SUMMARY

The invention relates to web packaging apparatus and methods transporting a web through a series of stations, for example forming a lower web into a component of a package receiving a food product and closed by an upper web.

Web packaging machines and methods are known in the prior art, for example U.S. Pat. No. 5,170,611, incorporated herein by reference. The apparatus packages a food product between upper and lower webs. A web transport conveyor transports the lower web through a series of stations which form the lower web into a component of a package at a forming station, and receive the food product at a loading station, and close the package with the upper web at a closing station. The present invention provides a pasteurization station pasteurizing the food product. In preferred form, the pasteurization station is between the loading station and the closing station and pasteurizes the food product in a simple effective manner readily and seamlessly incorporated into the packaging line.

BRIEF DESCRIPTION OF THE DRAWINGS

FIG. 4 is like FIG. 3 and illustrates sequential operation.

FIG. 5 is a view taken along line 5-5 of FIG. 4.

FIG. 8 is an exploded isometric view partially folded away of a portion of the structure of FIG. 6.

FIG. 9 is an isometric view of a portion of FIG. 3.

FIG. 10 is like FIG. 9 and illustrates sequential operation.

DETAILED DESCRIPTION

Figure 1:
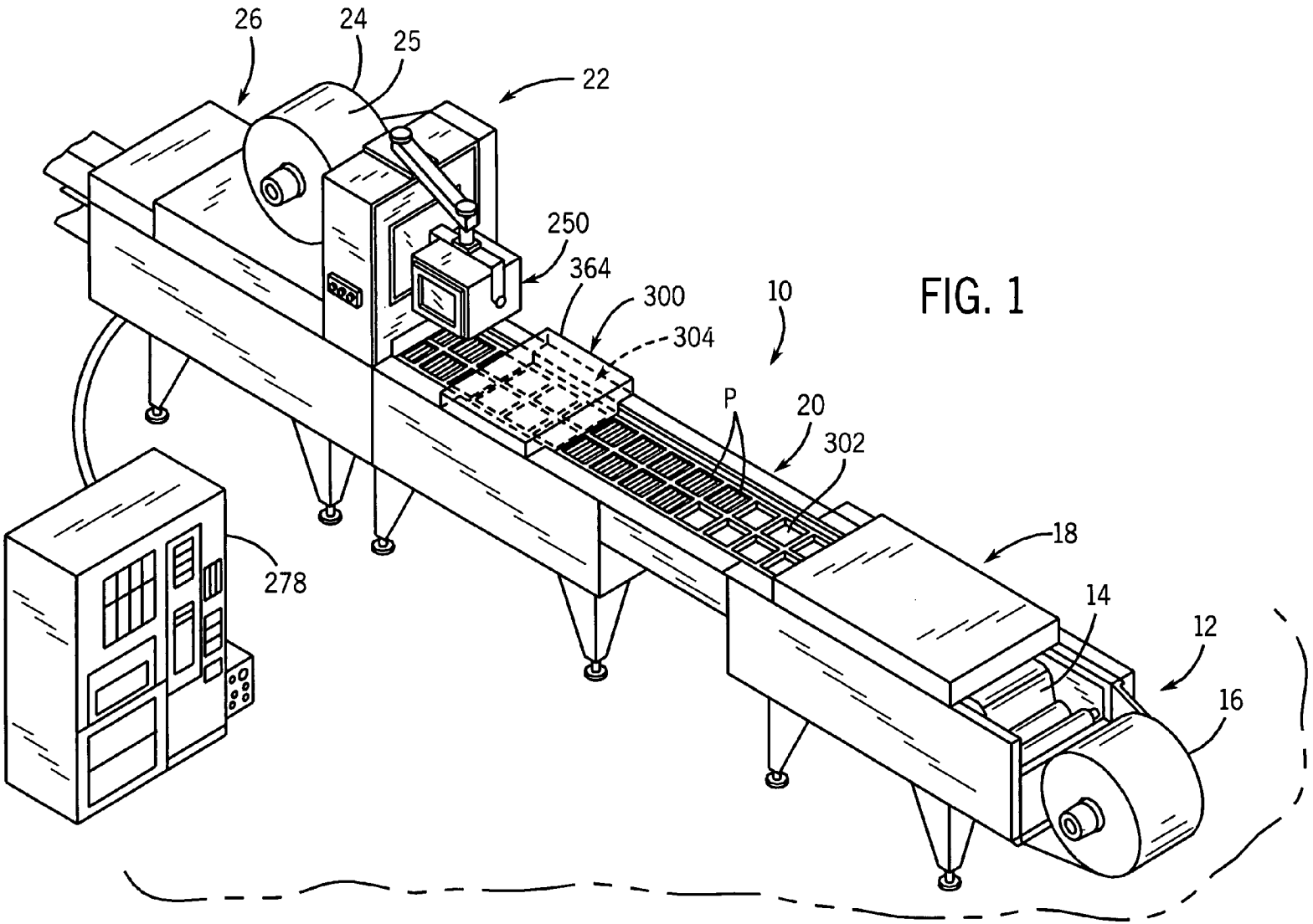
FIG. 1 is an isometric view of web packaging apparatus in accordance with the invention.

FIG. 1 illustrates a packaging machine 10 and is like FIG. 1 of incorporated U.S. Pat. No. 5,170,611 and uses like reference numerals therefrom where appropriate to facilitate understanding. As noted in the '611 patent, packaging machine 10 generally includes a lower web supply station 12 for supplying a lower web 14 of flexible packaging material from a supply roll 16, a forming station 18, a loading station 20, an upper web supply station 22 for supplying an upper web of flexible packaging material 25, and a downstream station 26 closing the package. As described in the '611 patent, the web transport conveyor provided by machine 10 transports lower web 14 through the noted series of stations which form the lower web into a component of a package at forming station 18, and receive the food product such as hot dogs P at loading station 20, and close the package with the upper web 25 at closing station 26. The webs are advanced by the indexing apparatus disclosed in the '611 patent, as controlled by the control modules 250 and 278, also as set forth in the '611 patent, to which further reference may be had. The conveyor advances from upstream to downstream, wherein closing station 26 is downstream of loading station 20, and loading station 20 is downstream of forming station 18.

Figure 2:
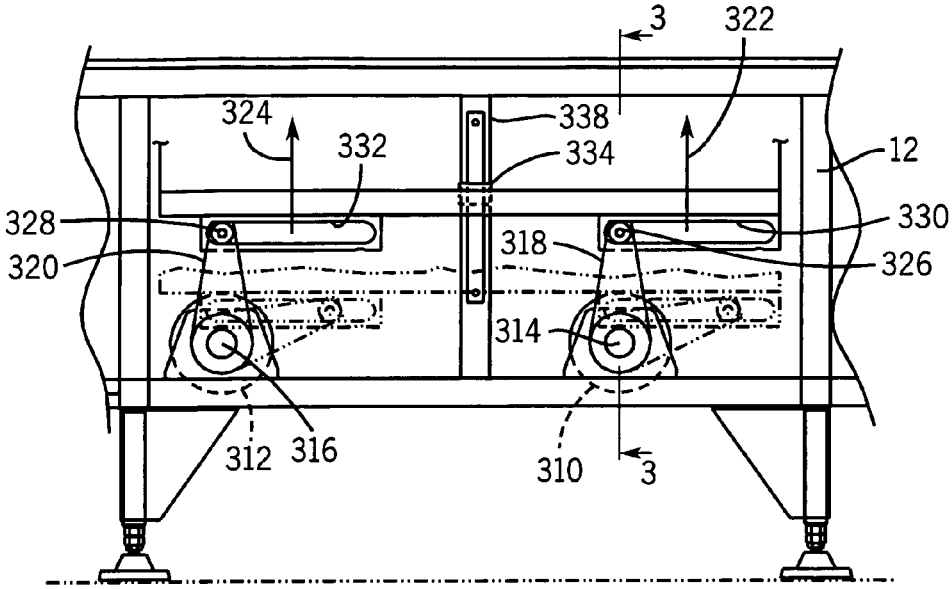
FIG. 2 is a side view partially cut away of a portion of the apparatus of FIG. 1.

The present invention provides a pasteurization station 300 pasteurizing food product P. Pasteurization station 300 is between loading station 20 and closing station 26. Pasteurization station 300 is downstream of loading station 20, and is upstream of closing station 26. Forming station 18 forms a downwardly depending product cavity pocket 302, FIGS. 1, 9, 3, in lower web 14 into which food product P is loaded, in accordance with the noted '611 patent. Pasteurization station 300 includes an upper chamber 304, FIG. 8, having a downwardly facing pasteurization cavity 306 facing product cavity pocket 302, FIG. 3, and pasteurizing food product P, to be described. Upper chamber 304 is above web 14. The pasteurization station includes a lower chamber 307 preferably provided by a form-inverter 308, FIGS. 8, 3, below the web and movable upwardly, FIG. 4, to engage the underside of web 14 and push food product P upwardly into pasteurization cavity 306 in upper chamber 304. Form-inverter 308 is preferably moved upwardly and downwardly by servo motors comparably to those used in the '611 patent for raising and lowering the forming box at forming station 18 for forming the noted product cavity pocket, for example as shown in FIGS. 2, 4, 5 of the '611 patent. Servo motors 310, 312, FIG. 2, rotate respective shafts 314, 316 which in turn rotate respective lift arms 318 and 320 from the lower position shown in dashed line in FIG. 2 to the upper position shown in solid line in FIG. 2 to in turn move form-inverter 308 upwardly as shown at arrows 322, 324, comparably to the upward movement provided by lift arms 128 and 216 in FIGS. 2 and 5 of the '611 patent. Roller members 326, 328 at the ends of respective arms 318, 320 roll along respective cam slots 330, 332 along the underside of form-inverter 308 comparably to roller member 132 in FIG. 5 of the '611 patent rolling along cam slot 134. The form-inverter is guided for up-down reciprocal movement by plastic bearing blocks 334, 336 sliding along vertical guides 338, 340 of frame 12, comparably to plastic bearing blocks 140 and guides 144 of the '611 patent. Upper and lower chambers 304 and 307 mate, FIGS. 4-7, to form a pressure-containing vessel enclosing cavity 306 sealed along its periphery in gasket-like manner by web 14 engaged between members 304 and 307 as shown at portion 341.

Figure 3:
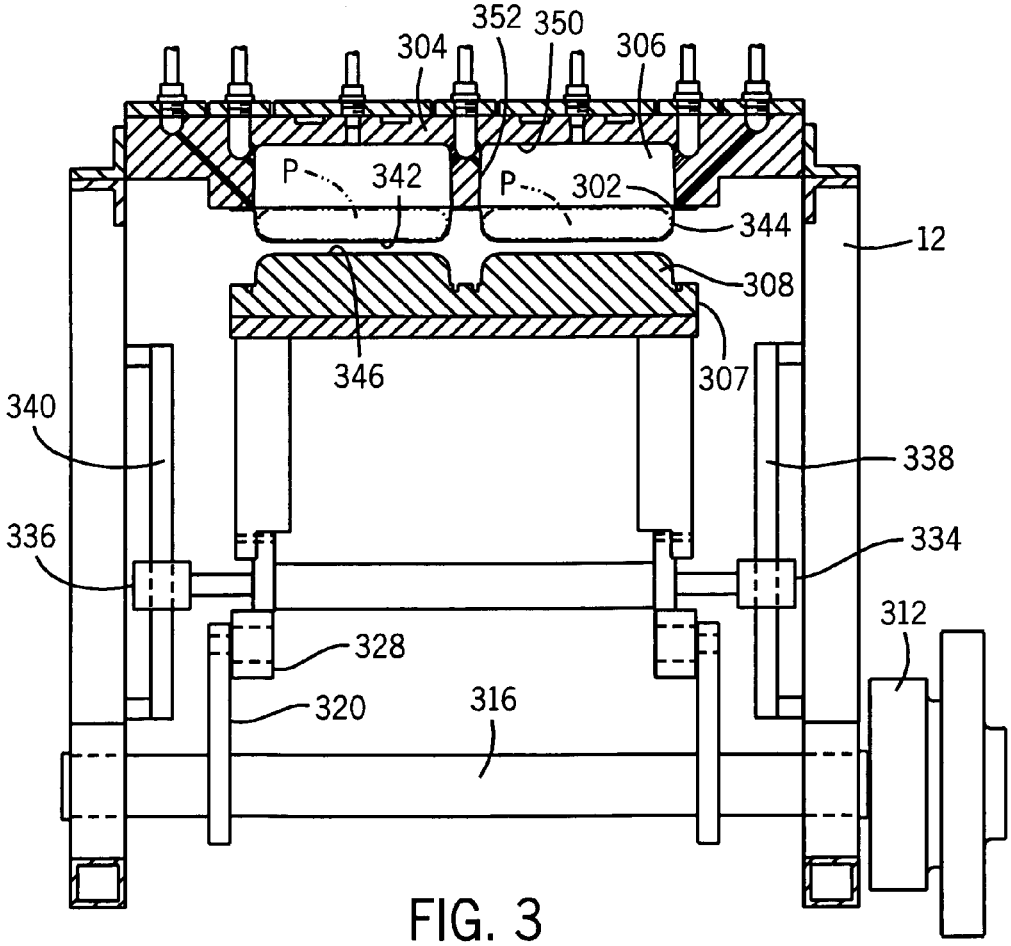
FIG. 3 is a view taken along line 3-3 of FIG. 2.

Product cavity pocket 302 of web 14 has a first condition, FIGS. 9, 3, at pasteurization station 300, with the downwardly depending product cavity pocket 302 having a lower central wall 342 and a plurality of sidewalls 344 extending upwardly therefrom. Product cavity pocket 302 has a second condition, FIGS. 10, 4, at the pasteurization station, with form-inverter 308 pushing central wall 342 upwardly to an upwardly pushed position, FIG. 10, with sidewalls 344 extending downwardly therefrom. Form-inverter 308 has an upper central wall 346, FIG. 9, and a plurality of sidewalls 348 extending downwardly therefrom. Product cavity pocket 302 in the noted second condition, FIG. 10, is draped over and supported by form-inverter 308, with central wall 342 on central wall 346, and sidewalls 344 extending along sidewalls 348. Product cavity pocket 302 has an initial condition as shown in FIG. 9 receiving food product P therein. The package is inverted as shown in FIG. 10 to better expose food product P for pasteurization. Upper chamber 304 has an upper central wall 350, FIG. 8, and a plurality of sidewalls 352 extending downwardly therefrom. In the noted first condition, FIGS. 9, 3, of product cavity pocket 302, food product P is supported on central wall 342 of the product cavity pocket and retained by sidewalls 344 of the product cavity pocket. In the noted second condition, FIGS. 10, 4, 5, of product cavity pocket 302, food product P is supported on central wall 342 of the product cavity pocket and laterally retained by sidewalls 352 of upper chamber 304.

Figure 6:
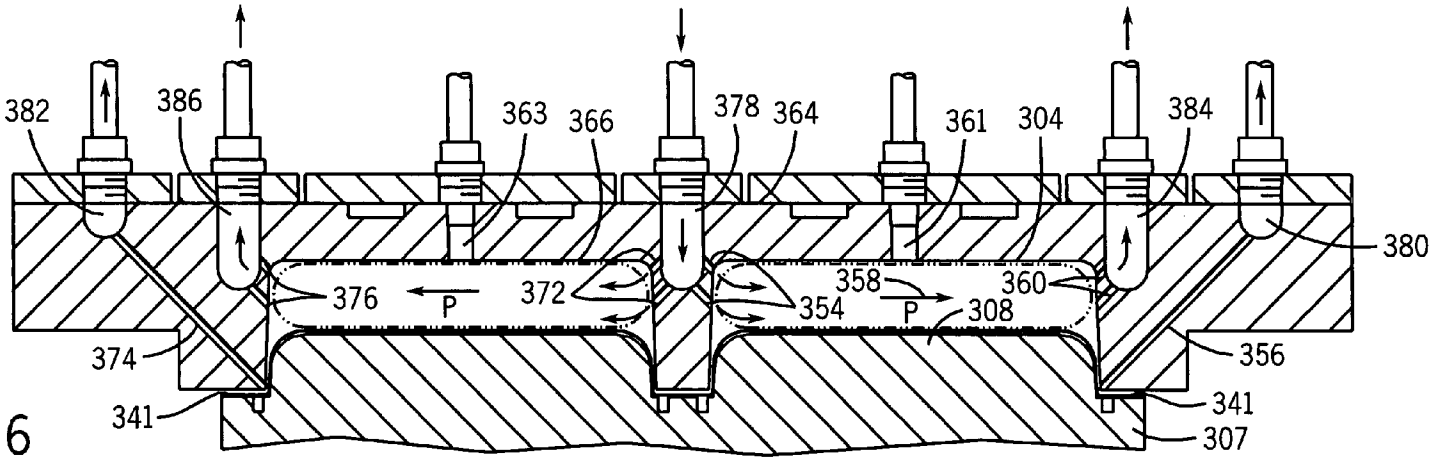
FIG. 6 is an enlarged view of a portion of FIG. 4.
Figure 7:
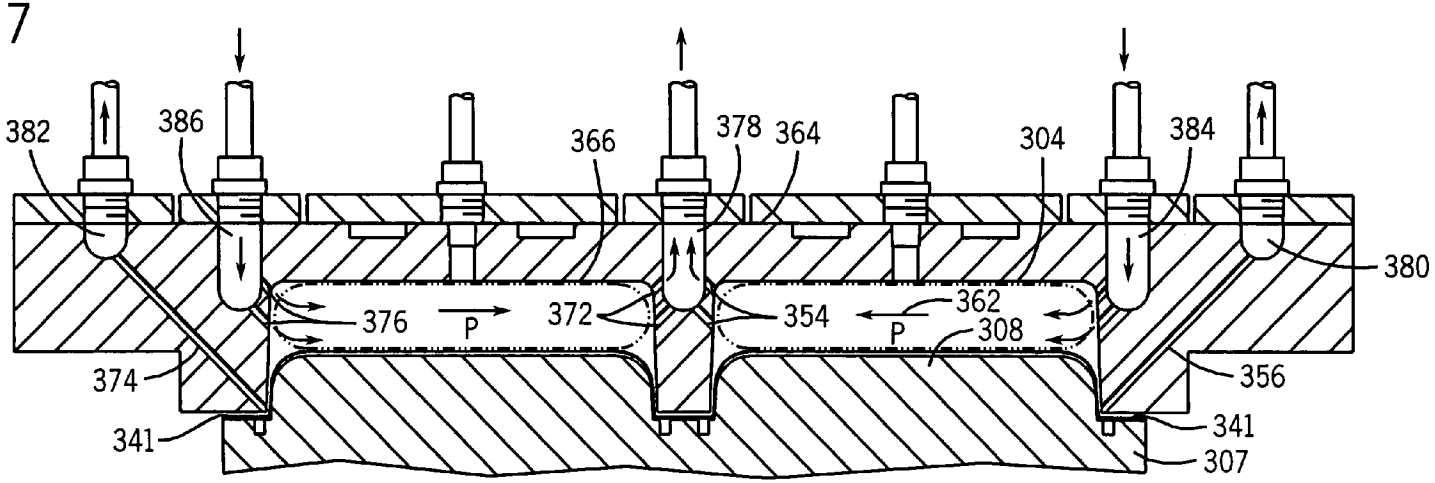
FIG. 7 is like FIG. 6 and illustrates sequential operation.

Pasteurization chamber 304, FIG. 6, has a set of one or more ports 354, and a set of one or more ports 356. Ports 354 introduce a pasteurizing medium, preferably steam, and ports 356 evacuate and vent the pasteurizing medium, such that the pasteurizing medium flows across food product P as shown at arrow 358 between ports 354 and 356. Ports 356 are at a gravitationally low section of pasteurization cavity 306 and also preferably discharge liquid condensate from the steam. Steam may be additionally or alternatively evacuated and vented at another set of one or more ports 360. In preferred form, pasteurization station 300 has a pasteurization cycle alternating between first and second modes providing alternating flow direction of the pasteurizing medium, preferably steam, across food product P. In the first mode, steam is introduced through ports 354, and in the second mode the steam is introduced through ports 360. In the first mode, the steam may be vented through ports 356 and/or ports 360. In the second mode, the steam may be vented through ports 356 and/or ports 354, the latter venting being shown at arrow 362 in FIG. 7. In another embodiment, steam is introduced simultaneously from both sets of ports 354 and 360. Pressure and/or temperature sensing is provided at pressure and/or temperature transducer ports 361, 363, for monitoring purposes and better process control if desired.

In one preferred embodiment, the pasteurization station is provided by a module 364, FIGS. 1, 8, having at least a pair of laterally spaced side by side chambers 304 and 366, FIG. 6, and further preferably a plurality of such pairs, for example one each of which is shown in FIG. 8 at 304, 368, 370 in series along the direction of web transport. The other chamber of each pair has a like set of ports; for example chamber 366, FIG. 6, has a set of one or more ports 372 and another set of one or more ports 374 and may have a further set of one or more ports 376. The pasteurization station may include one or more modules 364. Each module 364 has flow passages 378, 380, 382, and may have further flow passages 384 and 386. During the first mode of the pasteurization cycle, FIG. 6, steam is introduced through flow passage 378 and ports 354 and 372 into respective chambers 304 and 366 and is vented through respective ports 356 and 374 through respective flow passages 380 and 382, and may additionally or alternatively be vented through respective ports 360 and 376 through respective flow passages 384 and 386. Liquid condensate from the steam is discharged through respective ports 356 and 374 through respective passages 380 and 382. During the second mode of the pasteurization cycle, FIG. 7, steam is introduced through flow passages 384 and 386 and respective ports 360 and 376 into respective chamber 304 and 366, and is vented at respective ports 356 and 374 through respective passages 380 and 382 and may additionally or alternatively be vented at ports 354 and 372 through flow passage 378. Upon completion of pasteurization, the package is re-inverted to its noted initial condition, FIG. 9, by lowering form-inverter 308. The package is then advanced and closed with the upper web 25 at closing station 26 as in the noted '611 patent.

It is recognized that various equivalents, alternatives and modifications are possible within the scope of the appended claims. The term pasteurization is used herein in accordance with its normal dictionary definition, including partial sterilization of a substance at a temperature and for a period of exposure that destroys objectionable organisms without major chemical alteration of the substance, and including destruction of pathogenic and/or spoilage organisms for extending shelf life. The invention may be used with various web packaging apparatus known in the prior art, including continuous motion type web packaging machines and indexing type web packaging machines. It is preferred that plural packages of food product be simultaneously processed at the pasteurization station, FIGS. 8-10, though the invention is not limited to any particular number, i.e. the invention includes the pasteurization of one or more product packages. Furthermore, additional pasteurization stations may- be added, and the invention includes one or more pasteurization stations, each having one or more pasteurization chambers. Food product inversion is preferred, e.g. via form-inverter 308, but is not necessary, and may be deleted if desired. The pasteurizing medium is preferably steam, or alternatively hot air or superheated steam, though other types of pasteurizing media may be used.

What is claimed is:

1. A packaging system for packaging a food product, the packaging system comprising:

a non-perforated lower web of flexible packaging material;

a web transport conveyor transporting the non-perforated lower web from upstream to downstream locations through a series of stations, the series of stations comprising a loading station for placing the food product in a package defined by the lower web, a closing station for closing the package with an upper web of flexible packaging material, and a pasteurization station for pasteurizing the food product, the pasteurizing station located downstream of the loading station and upstream of the closing station;

the pasteurization station comprising a pasteurization chamber defined by a lower chamber member located below the non-perforated lower web and an upper chamber member located above the non-perforated lower web;

at least one of the upper and lower chamber members being movable towards and away from the other of the upper and lower chamber members into closed and open positions, respectively;

wherein in the closed position, the upper and lower chamber members directly seal with and sandwich the non-perforated lower web therebetween, the non-perforated lower web and the upper chamber member defining the boundaries of a pocket in the pasteurization chamber for holding food;

an entry port in the upper chamber member, the entry port configured to supply pasteurizing medium to the pocket when the upper and lower chambers are in the closed position;

a supply of pasteurizing medium connected to the entry port; and an exit vent in the upper chamber member and spaced from the entry port, the exit vent being open to the pocket so as to receive and continuously vent pasteurizing medium that is supplied to the pocket via the entry port when the upper and lower chamber members are in the closed position;

wherein the entry port and exit vent are configured such that during operation the pasteurizing medium passes into and out of the pocket without passing through the non-perforated lower web, without passing through an interface between the upper and lower webs, without passing between the upper and lower webs, and without the upper web in the pasteurization cavity.

* * * * *